United States Patent [19]

Cobbs, Jr. et al.

[11] 4,247,581

[45] Jan. 27, 1981

[54] METHOD OF COATING WITH FILM-FORMING SOLIDS

[75] Inventors: Walter H. Cobbs, Jr., Amherst; Robert G. Shong, Avon Lake; William R. Rehman, Vermilion, all of Ohio

[73] Assignee: Nordson Corporation, Amherst, Ohio

[21] Appl. No.: 842,265

[22] Filed: Oct. 14, 1977

[51] Int. Cl.[3] ..... B05D 3/02; B05D 1/02

[52] U.S. Cl. ..... 427/373; 427/421

[58] Field of Search ..... 427/373, 377, 421, 27, 427/30; 260/2.5 N; 239/414, 419, 242.5, 426, 591

[56] References Cited

U.S. PATENT DOCUMENTS

| | | | |
|---|---|---|---|
| 2,955,058 | 10/1960 | Foster | 427/373 |
| 3,245,828 | 4/1966 | Iwata | 427/421 |
| 3,607,341 | 9/1971 | Goins et al. | 427/373 |
| 3,640,916 | 2/1972 | Dill | 427/421 |
| 3,764,069 | 10/1973 | Runstadler et al. | 239/419 |
| 3,884,844 | 5/1975 | Plunguira et al. | 260/2.5 N |
| 3,979,535 | 9/1976 | Govindra | 427/421 |
| 4,026,828 | 5/1977 | Smiley | 260/2.5 N |
| 4,118,526 | 10/1978 | Gregorirr et al. | 427/373 |

FOREIGN PATENT DOCUMENTS

| | | | |
|---|---|---|---|
| 525928 | 6/1956 | Canada | 427/421 |

*Primary Examiner*—Ronald H. Smith
*Assistant Examiner*—S. L. Childs
*Attorney, Agent, or Firm*—Wood, Herron & Evans

[57] ABSTRACT

Surface coating methods and apparatus are disclosed which eliminate many of the disadvantages associated with known coating processes from pollution, equipment, materials, energy, labor and cost standpoints. According to techniques described, liquid compositions containing film-forming solids are formulated, then conveyed in the foam state towards a surface, and upon foam disintegration, form a film of solids on the surface. The techniques disclosed eliminate the need for solvents in paints or reduce volatile content to very minimal amounts. This method also enables polymeric compositions having high molecular weight to be employed as coating materials. Furthermore, the method has utility in nearly all coating processes where the film-forming solids are conveyed from a bulk state to a surface for coating.

39 Claims, 3 Drawing Figures

METHOD OF COATING WITH FILM-FORMING SOLIDS

BACKGROUND OF THE INVENTION

Surface coatings originated in the Stone Age. Paint was first used by early Egyptians who dispersed pigment in a binder such as egg white. Today, paint is still basically a uniform dispersion of a binder or vehicle and a pigment. The vehicle is usually made up of a film-forming component, such as a resin; the vehicle is thinned with a solvent. With the exception of a minor percentage of powdered and curable solid surface coatings, currently the coating and finishing industry is predominantly based upon solvent-containing coatings.

The coating and finishing industry has, however, focused with great intensity upon its operations and their effect upon man's environment. Present coating techniques tend to create odors, smog, health and safety hazards. Legislation towards reducing such hazards at all levels of coatings manufacture and use is well advanced and enforced. However, compliance is not resulting in substantial changes in types of coatings used, rather, coatings are almost exclusively based on the solvent systems. Perhaps the most serious concern of the industry today, from a standpoint of both raw materials and environmental control, is the solvent components of the paint. Related concerns are the high price of energy, labor costs and capital in converting paints and liquid coatings into useful films.

The problems of the industry are illustrated by the commonly employed processes of liquid spray-coating, electrostatic liquid spray-coating and electrostatic powder-coating. In the spray-coating application of a resinous material, it is usual to dissolve the resinous material in an organic solvent to provide a suitable viscosity for spraying. Such methods of spraying solvent mixtures of film-forming resinous materials require significant amounts of solvent and loose solvent in handling, coating and finishing useful articles. Electrostatic liquid spray-coating techniques have been employed for coating normally liquid materials, i.e., paints or solvent coatings which have been atomized by air, airless or centrifugal atomization techniques. With respect to each of the spray-coating techniques, it is therefore common practice to dissolve a film-forming solid in an organic solvent to allow the composition to be handled, atomized and deposited upon the article to be finished. In fact, in known liquid spraying techniques, it is usually essential to use a solvent for the resinous coating composition in order to obtain a satisfactorily sprayed coating. During handling, atomization or deposition of solvent coating compositions, solvents will escape, and if not effectively trapped, the solvents will become air contamination. Even after a solvent coating is spread or applied to the article, solvents leave or escape from the coating film by evaporation and these too become contaminants of the surrounding atmosphere. Furthermore, since most solvents react with oxidants, they contribute to the pollution problems not only by their toxicity and unpleasant odors but also by creating smog. Organic solvents are further released during oven baking operations on coatings and are carried from the baking oven to the atmosphere in the form of exhaust pollutions. In an attempt to overcome the pollution problems associated with solvent spray-coating techniques, sophisticated recovery and after burner systems are employed to trap or burn solvent effluents. The cost of installation and operation of such systems and incinerators to dispose of the waste solvent is a very sizable expense.

While the more recent electrostatic powder-coating technique employs no solvent, such a technique involves the use of costly coating material. This method operates on the principle of transporting a finely divided dry powder and for this purpose, bulk resin must be crushed to a fine, rather uniform particle size and mixed with pigments, fillers, hardeners and the like by sophisticated and rather expensive crushing and mixing equipment. Such equipment includes ball mills, hammer mills, kibblers, extruders, kneaders, and other compounding equipment; filters, sieves, conveyors and the like, all of which are employed to process the coating material into a dry powder form suitable for transportation to the atomizing equipment. But still the technical material problems remain in the electrostatic powder-coating technique because it is difficult to provide satisfactory dry powders which have long shelf-lives for handling and spraying, etc., and these problems diminish the solventless appeal of the powder-coating techniques.

An important part of this brief overview of background for this invention is the sophistication in coating materials that has occurred. The search for a high quality polymeric coating material which can be applied without air pollution has been extensive. However, for instance in the spray application of molten polymers or concentrated polymeric solutions, techniques have not advanced to any significant extent because of the formulators' lack of understanding of atomizing mechanisms and by a similar lack of understanding by spray equipment designers as to the nature of high polymeric liquids. There have been many studies undertaken which relate to theoretical energies required, and the relationship of viscosity, surface tension, temperature, etc., of the liquid coatings. However, for use with high polymers and their concentrated solutions, the viscosity measurements are relatively meaningless and often misleading as comparative indicators of the relative ease or difficulty in atomizing two different polymeric liquids. Rather, polymeric liquids are vastly different from Newtonian liquids. They are somewhat elastic, resist deformation by rapidly applied forces and exhibit varying degrees of spring-back or recoil. Presently there are no practical instrumentations capable of evaluating these values of polymeric liquids so that the forecast of their atomizability or energy required to convey them to a substrate can be achieved. At each stage of the process for atomizing and conveying a polymeric liquid to a surface, the liquid resists high speed deformation. Therefore, it may be understood why solvent additions have been employed because they have the effect of separating the polymeric molecules and facilitating their relative movement to make the solution easier to deform at high speeds and thus easier to atomize. However, even after considerable effort over many years has been expended to prepare high solids coating compositions containing above 50% by volume of polymeric and pigmentary solids, still little success has been achieved, and from 15 to 40% by volume of liquid solvent components is necessary in spite of these efforts.

In summary, the coating and finishing industry is still seeking ways and means to apply polymeric coating compositions without emission of polluting solvents and vapors, and with minimum expenditure of energy per unit of coating material applied. There is a substantial need for efficient and economical processes which are devoid of the problems associated with known techniques for coating surfaces.

SUMMARY OF THE INVENTION

This invention is directed to coating surfaces by a method which eliminates many of the disadvantages associated with the coating methods of the prior art discussed above from pollution, equipment, materials, energy, labor and cost standpoints. In one of its aspects, this invention eliminates the need for solvents in paints and coating formulations or reduces solvent content to minimal amounts heretofore unoperable. In another of its features, this invention enables high molecular weight polymeric compositions to be employed as coatings materials which heretofore have been incapable of such utility. Furthermore, this invention has utility in nearly all coating processes where film-forming solids are conveyed from a bulk state to a surface for protection or decoration. In a particular respect, spray-coating techniques, which have been materially hampered by environmental and raw material problems, are significantly advanced by the improved methods of this invention. These objectives, advantages and solutions to existing problems will become apparent in the detailed description of this invention.

In one of its features, the invention provides a method of atomizing and conveying bulk solids to a surface for coating. According to this invention, the film-forming solids are first foamed to a relatively stable, energized state and thereafter subjected to an atomizing force. The atomized particles are then conveyed to form a film on a substrate. In particular, it has been discovered that polymeric liquids or melts, otherwise somewhat elastic and resistant to deformation, can be atomized and sprayed after being placed in a foamed state. Heretofore, liquid paints have been sprayed by injecting air into them at the atomizer, see for example, U.S. Pat. No. 3,764,069 where the atomizing air is injected into a liquid film to form a froth and the bubbles of the froth then expand to fragment the liquid film thereby atomizing it. However, such methods utilize the energy of the atomizing force to form, as well as destroy, the froth. Such techniques, and other atomizing techniques, are unsuccessful in attempting to atomize and spray high polymeric or solventless coatings. In fact, it has not been considered economically feasible or practical to achieve atomization and spray-coating of liquid formulations having viscosities in excess of 300 centipoises. Now, using the principles of this invention, liquids are capable of being atomized and conveyed to a surface as a finished coating. Even polymeric liquids can be spray-coated.

Thus, this invention offers a solution to the search for high quality coatings which can be applied without air pollution. This invention further eliminates the need for development of instrumentation for evaluating polymeric liquids so as to predict their atomizability. According to this invention, high polymeric materials are placed in an energy form for small particle formation by previously having been converted to a foamed state. This use of energized, relatively stable foam in coating applications is considered unique. Heretofore, foam has been suppressed during manufacture, pigmenting, tinting and application of paint or coating materials. In complete contrast, in one of its aspects, this invention is predicated in part upon the discovery that relatively stable foams may be utilized to overcome a number of major problems which have existed in the finishing and coating industry for many decades. Furthermore, such relatively stable foam techniques, as herein described, enable the elimination of solvents, heretofore considered to be essential components of most coating compositions. The method of coating a surface with a film-forming solid according to this invention is capable of practice with non-volatile film-forming solids or substantially non-volatile solids so that savings of materials may be made by the elimination or nearly complete reduction of solvents. Furthermore, in addition to solvent material savings, the energy involved in eliminating such solvents during handling, atomization or deposition and curing of the coating composition is saved and the demand for petroleum solvent sources is relieved. Significantly, the health and safety hazards heretofore associated with the solvents of prior coating techniques are overcome.

In another form, the inventive method enables high polymeric materials to be coated by first foaming liquid compositions containing film-forming solids, then conveying the foam towards a surface and, upon foam disintegration, forming a film of solids on the surface. Heretofore, when an attempt was made to form high solids coating compositions from polymers, relatively low molecular weight materials had to be employed which would sag and run rendering them virtually useless for practical purposes. Such sagging problems are overcome by this invention which enables use of polymeric compositions having viscosities in excess of 300 centipoises, in the range of 300–30,000 centipoises, at application temperatures for coating substrates by such methods as atomization and spraying, roll coating, dip coating and the like. Heretofore, with known techniques, viscosity levels had to be maintained below about 300 centipoises in order to achieve atomization or coating. Moreover, the method of this invention is accomplished without resort to quantities of polluting solvents or water requiring large quantities of energy for evaporation.

The foam according to this invention may be of two morphological types, i.e., "sphere-foam" or "polyhedron-foam". Other names given to these types of foams, by reference in the literature are kugelschaum and polyederschaum; see article entitled "Bubbles and Foam" by Sydney Ross, "Chemistry and Physics of Interfaces, Vol. II" by Am. Chem. Soc., Copyright 1971, pp 15–25, ISBN 8412-0110-2. Herein, these foams are simply called "K-foam" and "P-foam". The sphere-foam consists of spherical bubbles widely separated from each other by liquid underneath the surface thereof, whereas the polyhedron-foam consists of bubbles that are nearly polyhedral in shape with thin, curved or plane films of liquid between them. In its most preferred form, this invention is directed to the utilization of the polyhedron-foam. In the polyhedron-foam, the thin films provide considerable surface energy, and such may be disintegrated or sheared by the force of the flow of, for example, an atomizing fluid. Thus, this invention makes use of the surface energy that has been provided so that the film-forming solids will be in a thin film for disintegration or atomization by the shearing flow of a pressurized atomizing fluid. The atomizing force may be an external fluid such as air, or air jets, which shear the foam. On the other hand, the atomizing force may be provided by an external hydraulic fluid.

In an essential respect, energy is stored in the film-forming solids in a foamed state before atomization so that materials, even with high viscosity, are placed in very thin films surrounding a gas or vapor to create the surface that is demanded for spraying of viscous polymeric materials. Therefore, the P-foam presents the most advantageous surface area deployment. Of course, it is to be understood that the principles of operation of this invention apply to the K-foam as well, but the surface area and energy presented in such foam are not optimized as in P-foam. Also, it should be understood that the K-foam may provide a transitional stage to the P-foam wherein the polymeric material is thinned out to its utmost form for disintegration and atomization for conveyance by spraying to a substrate. In contrast to the preferred P-foam herein, generally all long-lived foams that are of interest for their industrial application are desired in the K-form, and formulations are so developed to produce and retain it, as in the foamed-polymers, rubbers, shaving creams, whipped creams, etc.

In the case of prior polymeric structural, rigid and elastic foams, from the standpoint of the ratio of the volume occupied after foaming to the volume occupied before foaming, present practice of the known art operates at perhaps an upper limit of about 100:1. Furthermore, by comparison in U.S. Pat. No. 3,764,069 referred to above wherein gas is injected into a low viscosity liquid paint formulation to atomize same, the air to liquid mass ratio in the froth is approximately equivalent to a range of about 100:1 to 1600:1 from the standpoint of the ratio of volume occupied after frothing to volume occupied before frothing. In contrast, in the practice of this invention, the ratio of volume occupied after foaming to volume occupied before foaming ranges up to about 50:1, preferably from about 2:1 to 10:1 by volume. Thus, in spite of the large differences in such ratios according to the practice of this invention, in comparison to the ratios of the prior art, the liquid polymeric phase is subdivided into small cells whereby sufficient energy is supplied to create and insure adequate atomization. Whereas, according to the ratios defined in such prior art, not enough time-stability is achieved to carry out atomization notwithstanding the nature of the viscous coating material.

In another of its objectives, by the method of this invention highly viscous coating compositions are placed in a specific form for handling, conveying and coating into thin films by introducing a gas or vaporous material as a diluent in foam form to reduce their viscosity and to permit them to undergo such operations. Therefore, in comparison to prior techniques, this invention utilizes the concept of enhancing the controlled flowability of highly viscous materials by foam formation to achieve significant results and overcome problems long outstanding in the art of coating materials.

It will be understood that the liquid foamed compositions for surface coating according to this invention comprise liquid film-forming or polymeric components. Thus, the polymeric component may range from a liquid, to a semi-solid paste, to solid under normal conditions. Thus, the foams, while in a liquid state, may contain either solid or liquid film-forming components. The liquid state of the foam, or film-forming solids, may be enhanced by the application of temperature and, as such, hot melt foam compositions may be used according to the coating process of this invention. In the hot melt form or ambient liquid form, the foam thus may contain either thermoplastic or thermosetting resinous compositions. Presently, thermosetting coating resin compositions are especially preferred in the practice of this invention because of the present availability of such coating compositions and because of certain end properties achieved by such compositions in coating surfaces. For instance, thermoset compositions have principally been employed because there has been no satisfactory teaching heretofore of getting high molecular weight polymers conveyed from their bulk form to the surface to be coated. Also, thermoset compositions offer hardness required for many coating uses and, further, upon curing to their cross-linked high molecular weight state, resist solvent attack, and the like. For instance, a foam is formed by the action of heat, conveyed to a substrate either by spraying or other transfer, and then finished if necessary by heating. In this process, it has been found that thermosetting components may be employed in the formation of the foam and, even though polymerization is occurring during periods of foaming, conveyance and deposition upon the surface, the foam state still permits handling and processing to a finished coating on a surface.

Depending upon the method of coating conveyance, the composition will undergo different mechanisms of disintegration and film-forming upon a substrate. Where atomization and spraying are the modes of conveyance, foam disintegration will be initiated and occur prior to film-forming solids being deposited upon the substrate. As explained above, and in this instance, the ease of atomization of such high polymeric liquids is accomplished by reason of the energy that is stored in the liquid surface of the foam bubbles. In another form, however, foams of high polymeric solids may first be deposited upon a substrate by a suitable technique and disintegrated thereon to form a continuous film coating from the film-forming solids. It is also understood that in the conveyance, such as by atomizing and spraying, liquid polymer film-forming agent may become either tacky or powdered particles after or while being conveyed from the bulk state. These particles may subsequently be applied to the substrate by electrostatic forces, or otherwise, and then even heated to form a continuous film on the substrate.

This last mentioned form highlights the utility of the principles of this invention in particulating polymeric materials for many other utilities involving powdered polymers, for example, for the preparation of powdered coating materials, per se. At present, only certain materials are known in the art to be readily converted to powder form for application using electrostatic powder painting and coating apparatus. The principal materials are coincident with plastic practice; they are solids which are extruded in melt form, solidified and ground cyrogenically to fine powders at considerable expense. Many well known coating resins are not amenable to powder formation by grinding or the cost to do so is prohibitive. It is desirable to provide a more complete repertoire of coating resin materials in powder form in order to meet more application requirements by the powder painting approach. At present only epoxy, polyester, acrylic and other thermoplastic powders are available. The invention described above will provide in powder form for application any liquid foamable coating resin now know. Those include phenolic, polyamide, polyolefin, cellulosic, amino, styrene-butadiene and related copolymers, polyester, epoxy, polyurethane, vinyl, acrylic, and alkyd, as well as other thermoplastic and thermosetting resins known to the art.

In a preferred form, this invention enables the polymeric composition of high molecular weight to be conveyed to substrates by a most commonly employed technique of atomization by first forming a liquid foam composition, followed by disintegration and spraying. The conveyance technique may be spraying with compressed air, hydraulic or airless methods, electrostatic techniques, etc., all of which involve predominate or complete disintegration of the foam prior to deposition upon the substrate. Other methods of conveyance or application to which the principles of this invention apply include roll coating, dip coating, extrusion coating, curtain coating, and the like which involve the disintegration or destruction of the foam after deposition upon the coated surface. Generically, in all of these coating techniques, there is involved the preparation and conveyance of a coating composition in a relatively stable foamed liquid state for deposition of that coating composition upon a substrate to be film coated for usually decorative or protective purposes. Of course, the application of the principles of this invention are not to be limited to the techniques just noted, rather, other methods of application or conveyance in both domestic and industrial areas include brushes, tumbling, or coil coating, to mention a few.

In order to provide a liquid foam composition, the film-forming polymer as mentioned may be a liquid, semi-solid or solid form at normal or room conditions. Polymeric compositions can be obtained in liquid form, without the addition of solvents or other liquid diluents as by melting, for example. Thus, the foam composition is formed in the hot melt state with known blowing agents, either solids, gases or liquids. Common resins of the industrial coatings industry without solvents are therefore suitable including syrups of methacrylates, acrylates and copolymers thereof, alkyd resins, polyester resins, polyurethanes, epoxies, coating grade polyethylenes, ethylene vinylacetate copolymers, polyvinyl chlorides, various rubber compositions and the like. The coating and finishing resins presently primarily in use are alkyd polyester resins or polyesters. In this regard, the term "alkyd polyester" resin is intended to include those resins which are modified polyester resins, usually oil modified resins. And "polyester resins" are the synthetic resins derived from polyfunctional alcohols and acids. The next most important resin for industrial coatings of the present industry is made up of mainly acrylic polymers and copolymers, with the balance comprising vinyls, epoxies, polyurethanes, aminos, cellulosics and other similar resins. Therefore, it is to be understood that the film-forming component of the liquid compositions of this invention include a wide variety of polymeric components of the type just mentioned and well understood by those skilled in the arts of the paint and coatings industry. The principal polymeric composition which may be employed in any of the methods defined above depends upon the end use of the coating, the coating method employed, and so forth as will be well understood to a person of ordinary skill in the art. Sources existing in the surface coatings literature to illustrate the specific types of coatings for particular domestic or industrial applications include the handbook of "Surface Coatings" prepared by the Oil and Color Chemists' Association, Australia, in conjunction with the Australian Paint Manufacturers' Federation, the New South Wales University Press, 1974; Treatise on Coatings, Vol. 4 (in two parts entitled "Formulations, Part I", edited by R. R. Myers and J. S. Long, Marcel Dekker, Inc., 1975); and Paint Finishing in Industry by A. A. B. Harvey, Second Edition, Robert Draper, Great Britain (1967). These sources are included herein by reference for more detailed disclosures of compositions and coating techniques.

Therefore, the polymeric compositions which may be chosen for utilization in this invention are of a wide variety and the viscosity of such compositions, with or without solvents or diluents, may be varied over a wide range. Typically, the viscosity may be in the range up to, for example, 30,000 centipoises as measured by ASTMD3236 (Thermosel Viscosity) of the film-forming material through either variation of temperature, molecular weights or both. As noted before, prior art coating compositions in order to achieve atomization by prior art techniques, use polymer solutions having viscosities usually not in excess of 300 centipoises at application temperatures in order to achieve results of satisfactory quality. However, by employing the techniques of this invention, polymeric compositions having very high viscosities may be employed. Such polymeric compositions thus may comprise substantially nonvolatile solids or even 100% solids so that little or no pollution occurs either in the handling, conveyance or coating of the materials onto various articles.

In another form of the invention, relatively stable foams are formed to provide polymeric coating liquids and yet to eliminate the possibility of bubbles remaining under the surface of the coating material to thus mar its appearance and limit the life and protection afforded by the coating. In this aspect, it is an objective to prevent permanent bubbles from remaining in the polymeric coating on the substrate even under conditions favoring relative stable foam formation. For this purpose, a polymeric composition is obtained in liquid form without addition of solvents as disclosed above. Another liquid or combination of liquids is then chosen such that (a) the boiling point of this liquid at atmospheric pressure lies near the ring and ball softening point of the resin and (b) the saturation solubility of the liquid at its boiling point in the resin does not exceed 5% by weight of the resin. For instance, isopropanol and butanol are suitable liquids for coating grade polyethylene (Allied Chemical "AC635"). The amount of the chosen liquid as a blowing agent is chosen from about 0.05% to 5%, preferably 0.1% to 1%, by weight of the resin. It will be understood that if the liquid is too soluble (such as toluene for AC"635"), then foaming will not satisfactorily occur due to loss of blowing agent by diffusion. Furthermore, if an excessive amount of the liquid is employed, foaming may not occur. Thus, the range of liquid to resin weight will be governed by these factors to achieve the desired results as will be understood by one of skill in view of this description; and FIG. 3 hereinafter referred to illustrates the formation of foams by liquid blowing agents. Referring to FIG. 3 for the generalized situation, the uniform mixture of the resin with liquid blowing agents is heated to a temperature substantially above the boiling point of the liquid and simultaneously pressurized to a pressure at least high enough that it exceeds the vapor pressure of the liquid at that temperature. This pressurized mixture of resin and blowing agent is then pumped through temperature and pressure controlled tubes to the location of application to a substrate. Whereupon, the mixture of components is allowed to foam by release of pressure to atmospheric pressure or below with the temperature maintained above the boiling point of the liquid. This foam may then of course be applied to the substrate by dipping, spray atomization, roll coating, curtain coating, flow coating, wave-contact coating, etc. During conveyance or thereafter, as explained above, the foam is allowed to fall in temperature below the boiling point of the blowing liquid at atmospheric pressure whereupon the bubbles of the foam disappear either by evaporation and/or condensation of the liquid blowing agent. This process will be further exemplified hereinafter with reference to specific examples.

In the use of thermosetting coating compositions, this invention obtains certain unique advantages. For instance, as mentioned, polyester resin coating compositions are most widely employed in the industry. When a polyester resin is cured or cross-linked with hexamethoxymethyl melamine, or a similar curing agent, such as tetramethoxymethyl urea, methanol is the by-product of the reaction. In a preferred practice of this invention, methanol is introduced in a very minor amount as the foaming agent. Methanol has a very favorable vapor pressure for foaming of polyester resins and it is sufficiently soluble to produce a high quality foam formation. In this broader aspect, this invention therefore employs a liquid blowing agent which is a by-product of the thermosetting resin reaction and, thus, also by suppression of that reaction enables control of curing times while the foam coating is being conveyed and finished on a surface. This is advantageous in allowing for additional hold-up, storage and processing times of thermosetting coating compositions.

In addition to the above mentioned variability of polymeric formulations suitable for coating purposes, a number of different types of foaming agents may be employed in the method according to this invention. Exemplary of additional liquid foaming agents of the type described above are isopropanol, methanol, butanol and octanol. However, the foaming agent may also be a solid or gas according to the broader aspects of this invention. A number of compounds may be employed to provide the gas-forming agent in order to foam a liquid coating agent according to the principles of this invention. Included in such gas or gas-forming agents are azodicarbonamides, air, nitrogen, oxygen, carbon dioxide, methane, ethane, butane, propane, helium, argon, neon, flurocarbons such as dichlorodifluoro methane, monochloro trifluoro methane, or other gases, or mixtures of any of these gases. It is also to be understood that other additives may be employed in the coating compositions as is illustrated by the above comprehensive references upon formulation. These include pigments, carriers, driers, catalysts, flow control additives or the like, many of which, pigments for example, materially facilitate a clean break-up and disintegration of the foam. In this connection, reference is also made to the co-pending application of W. H. Cobbs, et al, Ser. No. 719,338, filed Apr. 27, 1977 for a disclosure of surfactants which may be employed to provide stabilized molten foam compositions by the addition of a surfactant in a sufficient stabilizing amount. In this regard, it will be understood that a surfactant may be employed to form a stabilized foam of P or K form for utility in this invention, as developed in detail above.

The principles of this invention will be further understood with reference to the following detailed examples and the drawing in which.

Figure 1:
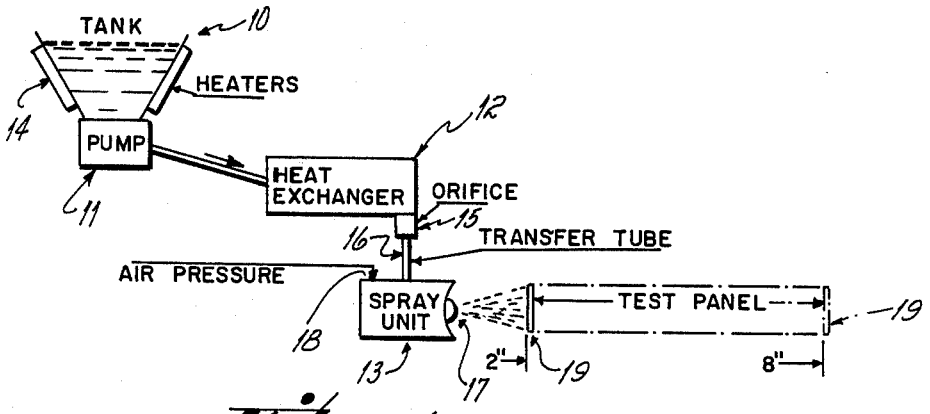
FIG. 1 is a schematic of a suitable apparatus for performing the foam coating method of this invention by a hot melt liquid blown technique.

Referring to FIG. 1 of the drawing, an apparatus for performing the method is shown. The apparatus employs a tank 10 or funnel grid for containing the paint composition having associated therewith a pump 11. The pump 11 illustrated is a typical air motor gear drive pump, however, any pump capable of providing sufficient pressure, up to 100 pounds, to pump the paint sample through the heat exchanger 12 on to the spray unit 13 is suitable. The apparatus of the FIG. 1 was operated for methanol foaming of a polyester resin paint composition of Example 1.

EXAMPLE 1

| | | |
|---|---|---|
| (1) | Polyester Resin | 415.5 grams |
| (2) | $TiO_2$ | 475.0 grams |
| (3) | Hexamethoxymethyl melamine | 178.1 grams |
| (4) | Silicone surfactant | 1.8 grams |
| (5) | Catalyst | 3.0 grams |
| (6) | Methanol (5% of resin solids) | 20.8 grams |
| | | 1094.2 grams |

The polyester resin employed above was 100% solids consisting essentially of adipic and phthalic acids polymerized with propylene glycol and trimethylolpropane. The viscosity of the polyester resin formula without methanol and catalyst was determined over the range of about 125° F. to about 225° F. to be about 45,000 to 4,000 centipoises.

The paint composition was introduced into the tank at about 77° F. The tank heaters 14 were operated to raise the temperature to allow the high viscosity paint composition to flow into the intake of the pump 11, i.e., about 130° F. From the pump, the paint composition passed under pressure through the in-line heat exchanger 12 to raise its temperature to 220° F., then through a 0.012 to 0.025 inch orifice 15 where it expanded to a foam in a ratio from about 2/1 to 8/1 in volume, and then via a transfer tube 16 to the entrance port of a spray unit 13, for instance a Model 61 Binks air spray unit. From the nozzle 17 of unit 13 (0.052 inch diameter) the foam issued at a temperature of 220° F. at a rate of about 2 oz. per minute. A pressure of 40–50 psig was applied to the air intake 18 of unit 13, whereupon the foam paint composition was atomized and conveyed to a test panel 19 of steel plate.

After baking the test panel 19 in an oven at 350° F. for 25 minutes, the thickness of the coating was found to be 0.8–1.0 mils using a magnetic gage. Pictures taken by flash photography show the atomization achieved at intervals of 2 inches from the nozzle outward to a distance of 8 inches from the nozzle. Cuts through the spray at a distance of 8 inches from the nozzle were made on black paper and showed a uniform distribution of fine paint composition particles. A stream of the foam was also photographed under a low power microscope and, at a point immediately outside the nozzle 17, exhibited a cellular P-structure plus accompanying K-structures.

A portion of foamed formulation from the nozzle was run onto a preheated metal panel (200° F.); a preheated hand-roller (200° F.) was used to roll out the foam into a film measuring 0.5 mils in thickness.

EXAMPLE 2

72.3% Epon 1001 (Shell Chemical Co.)
4.5% Epon 828 (Shell Chemical Co.)
18.9% Hexamethylmethoxy melamine
3.4% Methanol
0.9% Catalyst The above formulation (percent by weight) was prepared by melting the Epon 1001 resin at about 200° F. containing in admixture Epon 828. The hexamethylmethoxy melamine was added to the resin mixture with agitation at 150°–200° F. The mixture was allowed then to cool to below about 140° F. before the addition of methanol, whereupon the methanol was slowly added under continuous agitation. The catalyst was finally mixed into the resultant resin composition. Prior to the addition of the catalyst and methanol, the viscosity of this clear enamel formula was 2090 centipoises by ASTM D3236 at 200° F. This formulation was pumped through the heat exchanger of the apparatus illustrated in FIG. 1 modified to allow material to flow out of tube 16 onto preheated test metal panels. The material foamed onto the panels copiously. The foam was easily rolled out as a clear thin film approximately 0.5 mil thick using a preheated hand roller. A hard clear film coating remained after baking for 20 minutes at 350° F. Another portion of this formulation was sprayed through the apparatus of FIG. 1 at a nozzle temperature of 219° F. at about 3 oz./min. Atomizations were excellent and test panels were made and baked out at 350° F. for 30 minutes.

EXAMPLE 3

A coating grade polyethylene (Allied Chemical 635) was melted in the tank of the apparatus illustrated in FIG. 1 at 350° F. The viscosity by ASTM D3236 was found to be 2800 cps at 350° F. Into the inlet of the pump, isopropanol, approximately 1% by weight, was added to the molten polyethylene. The pump was operated to produce a pressure of 500–1500 psig at the outlet of the pump. Molten polyethylene containing isopropanol issued from the outlet and foamed copiously as caught on a paperboard. An insulated and heated metal tube was used to connect the pump outlet to the air spray unit; an orifice either 0.012 or 0.020 in diameter was placed in this connecting line. The spray unit used a 0.052 nozzle; it was enclosed inside a clamp type electrical pipe heater and heated to 350° F. The temperature of the molten polyethylene foam issuing from the nozzle was found to be 350° F. 80 pounds air pressure was applied to the spray unit and the foamed polyethylene was spray atomized onto test panels and paper test pieces. Atomization was good and test panels were uniformly covered on heating in an oven for a few minutes at 350° F.

The example above was repeated using air as foaming agent in place of isopropanol; results were comparable upon atomization and upon heating in the oven. Powdered polyethylene may be recovered employing this technique and this illustrates the practice of this invention in the preparation of powdered materials.

EXAMPLE 4

The following formulation was mixed and melted in the same apparatus defined above for the polyethylene, Example 3:

| | |
|---|---|
| Ethylene/Vinyl Acetate copolymer (70/30) | 1400 g |
| parrafin wax | 600 g |
| aerosol OT | 20.2 g |
| Cab-O-Sil Fused Silica by Cabot Standard Grade M5 | 2.02 g |

The melted formulation was foamed with isopropanol following the procedure of the polyethylene Example 3. Panels spray coated under such conditions exhibited excellent atomization and coated surfaces. The viscosity of the melted formulation at 350° F. was approximately 3050 cps by ASTM D3236.

Upon repeat of the above example with air instead of isopropanol as the foaming agent, very similar results were achieved.

EXAMPLE 5

A polyamide, i.e., a nylon 12 polyamide formed from sebacic acid and hexamethylenediamine having a viscosity by ASTM D3236 of 9000 cps at 450° F., was soaked overnight in 2-octanol. The melting point of the resin before soaking was about 210°–215° F. The vapor pressure of 2-octanol at 450° F. is approximately 3.4 atmospheres. Pellets were melted in the apparatus of U.S. Pat. No. 3,973,697 FIG. 1 G. N. Crum et al. issued Aug. 10, 1976 and dispensed onto a preheated metal plate. The melt foamed copiously on issuing from the gun onto the plate. The foam formed was rolled on the plate by pressing both through preheated, spring loaded rollers about 2 inches in diameter. The experiment was repeated using pellets not soaked in 2-octanol. The table below compares foamed and unfoamed coatings on the metal substrate for thickness at various roll pressures.

| Temp | Roll Press | Nonfoam | Foam |
|---|---|---|---|
| Orifice-450° F. | 0 (rolls just touching) | 1.5–2.0 mils | 1.3–1.5 mils |
| Panel-440° F. | ½ turn | 1.3–1.5 mils | 1.0–1.3 mils |
| Rolls-150° F. | 1 turn | 1.0–1.2 mils | 0.8–1.0 mils |
| | 5 turns | 0.4–0.5 mils | 0.3–0.4 mils |

Films from foamed material were continuous and appeared as good in quality as the non-foamed films. As may be observed from the above values, films from foamed material were all slightly thinner.

EXAMPLE 6

The following ingredients were formulated on a percent by weight basis:

12.7% VYLF Union Carbide, resin, i.e., copolymer of vinyl chloride and vinyl acetate in a ratio of 88:12
12.7% Hexamethylmethoxy melamine
47.2% Dioctyl Phthalate plasticizer
0.3% Thermolite 49 Stabilizer (M & T Chemicals)
0.4% Thermolite 31 Stabilizer (M & T Chemicals)
25.4% $TiO_2$
1.3% Methanol The above vinyl resin, hexamethylmethoxy melamine and $TiO_2$ were mixed together in a container and agitated at high speed. While under agitation, the stabilizers above mentioned were added near the start of the grind to avoid degradation due to heat. After approximately 30 minutes, the mixture was reduced with the plasticizer and methanol. Whereupon the mixture was again agitated until a thorough blend was achieved. The viscosity by ASTM D3236 was 2090 cps (without methanol) at 200° F. This coating composition formula was processed with the apparatus of FIG. 1 by the introduction into the tank at about 125° F., whereupon the composition was transferred to the heat exchanger at about 250° F. and spraying was achieved with a nozzle temperature of about 225° F. under an air pressure of about 45 psig. Atomization cuts of the test were taken and considered to be good. Upon spraying, sprayed film thicknesses of about 2–2.5 mils (wet thickness) were achieved and subsequently baked.

EXAMPLE 7

Figure 2:
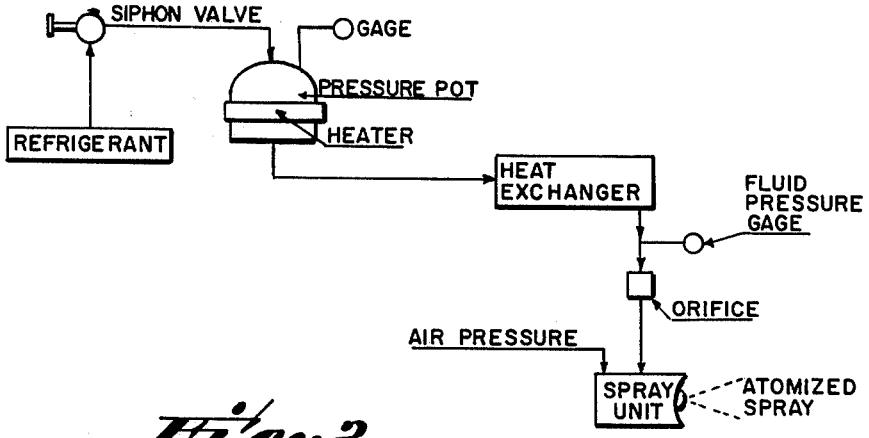
FIG. 2 is a schematic of other apparatus for performing the foam coating method of this invention by a gas blown technique.
Figure 3:
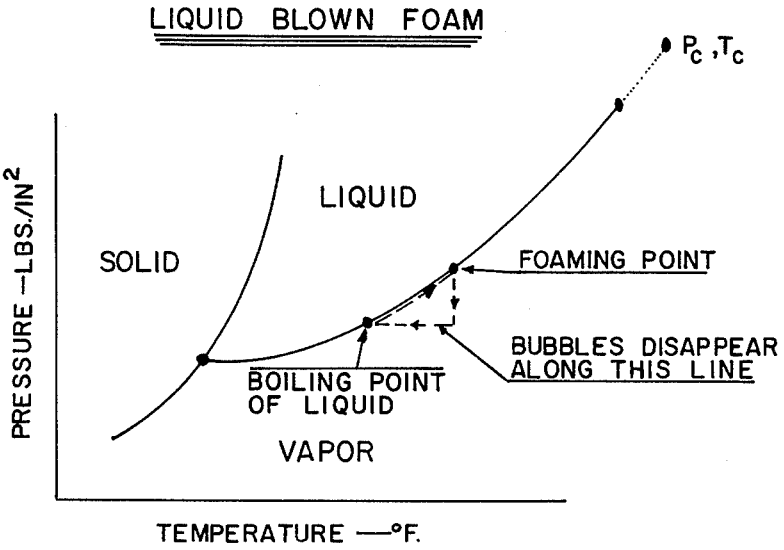
FIG. 3 illustrates the formation of foams by liquid blowing agents.

The apparatus illustrated in FIG. 2 was employed in this example. As illustrated, a pressure pot was employed for heating and pressurizing the coating formula. The pressure pot had a stirrer, pressure gage and source of refrigerant 12. A heater was also associated with the pressure pot. An acrylic enamel extended with polyester resin was formulated by combining the following components.

| | |
|---|---|
| Acrylic Resin (Dupont, "Elvacite" EP2028) | 261.9 |
| Acrylic-Polyester Resin Castolite-AF (The Castolite Company) | 1900.7 |
| Hexamethylmethoxy Melamine | 930.1 |
| Titanium Dioxide | 2479.2 |
| Silicone Surfactant | 8.6 |
| Methanol | 108.4 |
| Catalyst | 11.3 |
| | 5700.2 |

The viscosity of this formulation was determined to be 1100 cps at 200° F. by ASTM D3236. The material was placed in a 2-gal. capacity paint pressure pot; approximately one pound of refrigerant 12 ($CF_2Cl_2$) was added to the paint with venting to remove air from the vessel. The stirrer was operated to mix the liquid refrigerant 12 with the enamel formulation. The siphon tube of this paint pressure pot was connected to the input of the heat exchanger and to an air spray unit. On opening the siphon tube valve a copiously foaming liquid issued from the nozzle of the air spray unit at a rate from 2–3 oz/min., temp. was 200° F. 50 pounds air pressure was applied to the air spray unit. The foamed enamel was atomized and sprayed. Black paper cuts at 8 inches from the nozzle, perpendicular to the spray stream, showed atomization to be of good quality. Test panels were made and air dried.

In view of the above detailed description and operating examples, other modifications and embodiments of the practice of this invention may be employed without departing from the scope hereof.

What is claimed is:

1. A method of coating a surface with film-forming solids comprising:

first forming a stream of relatively stable liquid foam composition containing film-forming solids, then applying an external atomizing force to said stream to disintegrate said foam and to atomize said foam into atomized particles of said film-forming solids, and conveying the atomized foam particles to form a film of said solids on said surface.

2. The method of claim 1 wherein said atomizing force is an external fluid which shears said foam.

3. The method of claim 1 wherein said atomizing force is hydraulic pressure.

4. The method of claim 1 wherein said foam is formed by pressurizing a liquid composition containing a blowing agent and releasing the pressure to form the foam.

5. The method of claim 4 conducted under the action of heat and where the blowing agent is a liquid which vaporizes to form the foam upon the release of pressure.

6. The method of claim 5 wherein said foam is atomized by external air flow.

7. The method of claim 1 wherein said liquid composition contains polymeric film-forming solids.

8. The method of claim 7 wherein said polymer comprises a thermosetting resin composition.

9. The method of claim 8 wherein said thermosetting resin is a polyester resin.

10. The method of claim 9 wherein said polyester resin contains a liquid blowing agent to form said foam.

11. The method of claim 10 wherein said liquid blowing agent is a by-product of a thermosetting reaction of said resin.

12. The method of claim 9 wherein said thermosetting resin is a polyester resin and the foam is formed by a liquid foaming agent.

13. The method of claim 12 wherein said liquid blowing agent is methanol.

14. The method of claim 1 wherein said liquid composition is a thermosetting composition and the method is conducted under the influence of heat to form a cured solid film on said surface.

15. The method of claim 1 wherein said liquid foam composition consists essentially of a polyhedron-foam.

16. The method of claim 1 wherein said foam is formed from a heated liquid comprising a polymeric material containing a liquid blowing agent, said liquid blowing agent having a boiling point at atmospheric pressure which is near the softening point of said polymeric resin and having a saturation solubility in said resin not exceeding an adequate amount by weight of the resin for foam formation.

17. The method of claim 16 wherein said saturation solubility does not exceed about 5% by weight of said resin.

18. The method of claim 16 wherein the liquid is heated to a temperature substantially above the boiling point of the blowing agent and simultaneously pressurized to a pressure which at least exceeds the vapor pressure of the blowing agent at said temperature.

19. The method of claim 18 wherein the pressurized composition is pumped through temperature and pressure controlled tubes to the dispensing nozzle.

20. The method of claim 19 wherein foaming occurs by release of pressure and the temperature is above about the boiling point of the liquid.

21. The method of claim 1 wherein said foam composition contains a polymer having a viscosity in excess of about 300 centipoises under said foaming and atomizing conditions.

22. The method of claim 21 wherein said viscosity is in the range of about 300–30,000 centipoises.

23. The method of claim 1 conducted with substantially non-volatile compositions.

24. The method of claim 1 conducted with 100% solids coating composition.

25. The method of claim 1 wherein the ratio of volume of said composition occupied after foaming to volume occupied before foaming of said liquid ranges up to about 50:1 by volume.

26. The method of claim 25 wherein said ratio is from about 2:1 to 10:1 by volume.

27. A method of coating a surface with film-forming solids comprising:

first forming a stream of relatively stable liquid foam composition containing film-forming polymeric solids, wherein said foam consists essentially of a polyhedron state, then applying an external atomizing force to said stream to disintegrate said foam into atomized particles of said film-forming solids and spraying said composition towards said surface, and forming said film-forming solids on said surface as a continuous film.

28. The method of claim 27 wherein said foam is formed by heating said polymeric composition with a blowing agent.

29. The method of claim 27 wherein said blowing agent is a liquid having a boiling point at atmospheric pressure which is near the softening point of said polymeric resin and having a saturation solubility in said resin not exceeding an adequate amount by weight of the resin for foam formation.

30. The method of claim 28 wherein said composition is a thermosetting polyester resin composition.

31. The method of claim 30 wherein said blowing agent is methanol.

32. The method of claim 27 wherein said film is formed by thermosetting said solids to a hardened state on said substrate.

33. The method of claim 28 wherein said composition, after atomization, solidifies upon said surface as a powder which is then heated to form said film.

34. The method of claim 27 wherein said foam is atomized by external gaseous means.

35. A method for coating a surface with film-forming solids comprising:

providing a liquid composition containing thermosetting film-forming solids and a liquid foaming agent, heating said composition to a flowable solubilized state, conveying said composition, forming a stream of relatively stable liquid foam composition wherein the ratio of volume of said composition occupied after foaming to volume occupied before foaming of said liquid ranges up to about 50:1 by volume, then applying an external atomizing force to said stream to disintegrate said foam into atomized particles of said solids composition, spraying said atomized composition towards said surface, disintegrating said foam during said conveyance, and collecting said solids on said surface for the formation of a film of said solids on said surface.

36. The method of claim 35 wherein said foam consists essentially of a polyhedron state prior to said atomization.

37. The method of claim 35 wherein the composition is heated to a temperature substantially above the boiling point of the foaming agent and simultaneously pressurized to a pressure which at least exceeds the vapor pressure of the agent at said temperature.

38. The method of claim 37 wherein the pressurized composition is pumped through temperature and pressure controlled tubes to an atomizing nozzle for atomization.

39. The method of claim 38 wherein foaming occurs by release of pressure and the temperature is above about the boiling point of the liquid.

* * * * *